US006415932B1

(12) United States Patent
Fiscus et al.

(10) Patent No.: US 6,415,932 B1
(45) Date of Patent: Jul. 9, 2002

(54) GUN BARREL REST WITH DETACHABLE EXTENDER

(76) Inventors: Jon Fiscus, 610 Hillside Ct.; Shelley Nehrt, 135 E. Hillside Rd., both of Barrington, IL (US) 60010; Dave Story, 1048 Georgian Pl., Bartlett, IL (US) 60103

( * ) Notice: Subject to any disclaimer, the term of this patent is extended or adjusted under 35 U.S.C. 154(b) by 0 days.

(21) Appl. No.: 09/761,057

(22) Filed: Jan. 16, 2001

(51) Int. Cl.[7] ..... A47F 5/00
(52) U.S. Cl. ..... 211/64; 211/87.01; 211/60.1
(58) Field of Search ..... 211/64, 70.2, 70.8, 211/60.1, 68, 87.01

(56) References Cited

U.S. PATENT DOCUMENTS

D157,241 S * 2/1950 Del Pozo
2,855,108 A * 10/1958 Haapala ..... 211/64
2,959,295 A * 11/1960 Howard et al. ..... 211/64
3,746,177 A * 7/1973 Vilotti ..... 211/64
5,022,536 A * 6/1991 Pierson ..... 211/4
5,265,950 A * 11/1993 Atkinson ..... 211/64 X
5,325,686 A * 7/1994 Bentley
5,454,931 A * 10/1995 Lauve ..... 211/64 X
5,560,497 A * 10/1996 Mulvihill ..... 211/64 X
5,626,379 A * 5/1997 Scott ..... 211/64 X
5,669,515 A * 9/1997 Tisbo et al. ..... 211/70.6
5,827,487 A * 10/1998 Holmes ..... 211/70.6 X
5,979,675 A * 11/1999 Moriarty ..... 211/60.1

* cited by examiner

*Primary Examiner*—Robert W. Gibson, Jr.

(57) ABSTRACT

The present invention relates generally to a gun barrel rest, and specifically to a gun barrel rest for supporting both scoped and non-scoped guns in an upright or vertical position. The gun barrel rest includes a front portion and a rear portion. The front portion include a plurality of concave-shaped gun barrel rest recesses into which the gun barrel is placed. An extender is provided for increasing the distance between the vertical wall and the gun. The extender includes a tongue and a extender recess. The tongue is adapted for insertion into any one of the gun barrel rest recesses, and is adapted to matingly engage the gun barrel rest. When the barrel of the gun is inserted into the extender recess, the gun is positioned at a greater distance from the vertical wall.

17 Claims, 4 Drawing Sheets

GUN BARREL REST WITH DETACHABLE EXTENDER

FIELD OF THE INVENTION

The present invention relates generally to a gun barrel rest, and specifically to a gun barrel rest for supporting both scoped and non-scoped guns in an upright or vertical position.

BACKGROUND ART

Many types of support racks have been devised for long-arm guns such as rifles and shotguns. Such racks can generally be divided into two classes: those which store such guns horizontally, and those which store rifles and shotguns in a vertical position. Although racks capable support long-arm guns in a vertical position typically have been devised, there is a need for a gun barrel rest which can be used within a gun storage cabinet. Further, there is a need for a gun barrel rest capable of supporting one or more scoped long arm guns, non-scoped long arm guns, or combinations thereof, while maximizing storage space within the gun storage cabinet.

Therefore, it is a first object of the present invention to provide an apparatus for supporting one or more long arm guns.

A second object of the present invention is to provide a gun barrel rest for supporting one or more long arm guns in an upright or vertical position.

Another object of the present invention is to provide a gun barrel rest for supporting one or more long arms in a side-by-side fashion.

Yet another object of the present invention is to provide a gun barrel rest that is easy and economical to manufacture.

Another object of the present invention is to provide a gun barrel rest adapted for use within a gun storage cabinet.

A further object of the present invention is to provide a gun barrel rest which can be adapted to support non-scoped long arm guns, scoped long arm guns, or combinations thereof.

Another object of the present invention is to provide a gun barrel rest extender for storing scoped long arm guns.

Yet another object of the present invention is to provide a gun barrel rest that serves to eliminate or reduce undesired twisting or other movement of the long arm gun being supported.

SUMMARY OF THE INVENTION

The above-listed objects are met or exceeded by the present apparatus for supporting both scoped and non-scoped guns in an upright or vertical position within a gun storage cabinet. The gun barrel rest includes a front portion and a rear portion. The front portion include a plurality of concave-shaped gun barrel rest recesses into which the gun barrel is placed. Each recess is of sufficient depth and width so as to substantially prevent the barrel of the gun from moving horizontally, along a longitudinal axis of the gun barrel rest. The gun barrel rest positions the gun at a first distance from the vertical wall.

An extender is provided for increasing the distance between the vertical wall and the gun. The extender includes a tongue and an extender recess. The tongue is adapted for insertion into any one of the gun barrel rest recesses, and is adapted to matingly engage the gun barrel rest. When the barrel of the gun is inserted into the extender recess, the gun is positioned at a second distance from the vertical wall.

BRIEF DESCRIPTION OF THE DRAWINGS

Other objects and advantages of the invention will become apparent upon reading the following detailed description and upon reference to the drawings in which.

WRITTEN DESCRIPTION OF THE INVENTION

Figure 1:
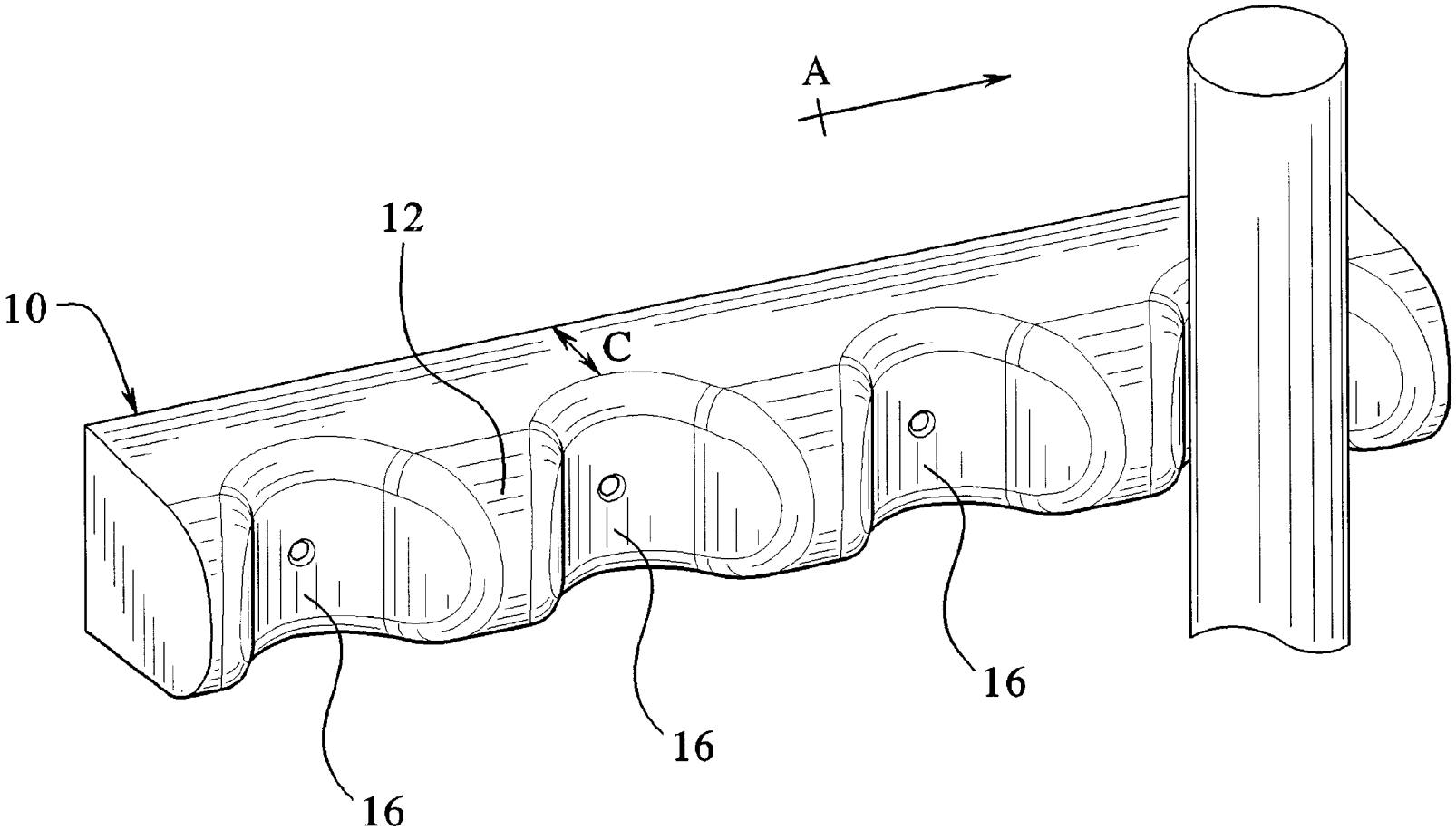
FIG. 1 is a front perspective view of a gun barrel rest.

While this invention is susceptible of embodiment in many different forms, there is shown in the drawings and will herein be described in detail, one specific embodiment, with the understanding that the present disclosure is to be considered merely an exemplification of the principles of the invention and is not intended to limit the invention only to the embodiment illustrated.

Referring to FIG. 1, a gun barrel rest 10 of the present invention is shown and described. In the preferred embodiment, the gun barrel rest 10 is a unitary member constructed from a rigid material such as plastic, metal, or the like.

The gun barrel rest 10 includes a front side 12. The front side 12 includes a plurality of substantially concave-shaped barrel recesses 16, each provided for supporting a gun barrel. As shown in FIG. 1, the gun barrel rest 10 has four such recesses 16. However, the invention is not so limited. Alternate gun barrel rests 10 are contemplated which include one or more recesses 16.

In those embodiments employing more than one recess 16, it is preferred that the distance between each recess 16 be sufficient to substantially prevent the guns from touching each other. In other word, when two guns are supported by adjacent recesses 16, the relevant sides of each gun should be substantially prevented from contacting the side of one another.

It is preferred that each recess 16 be of sufficient depth and width so as to substantially prevent the barrel of the gun being supported from moving horizontally or along a longitudinal axis, defined by line A, of the gun barrel rest 10. Although the depth and width of each recess 16 will depend upon the characteristics of the gun with which the present invention is utilized, one with ordinary skill in the art would be capable of determining the requisite depth and width.

Long arm guns vary in caliber, and therefore have varying barrel diameters. In the preferred embodiment, each recess 16 is of equal depth and width. Further, each recess 16 has a sufficient depth and width to accommodate long arm guns of larger caliber, such as a 10-gauge shotgun or the like, and guns having more than one barrel, such as over/under and side-by-side shotguns. Alternate embodiments are contemplated wherein the depth and width of each recess 16 varies.

Figure 2:
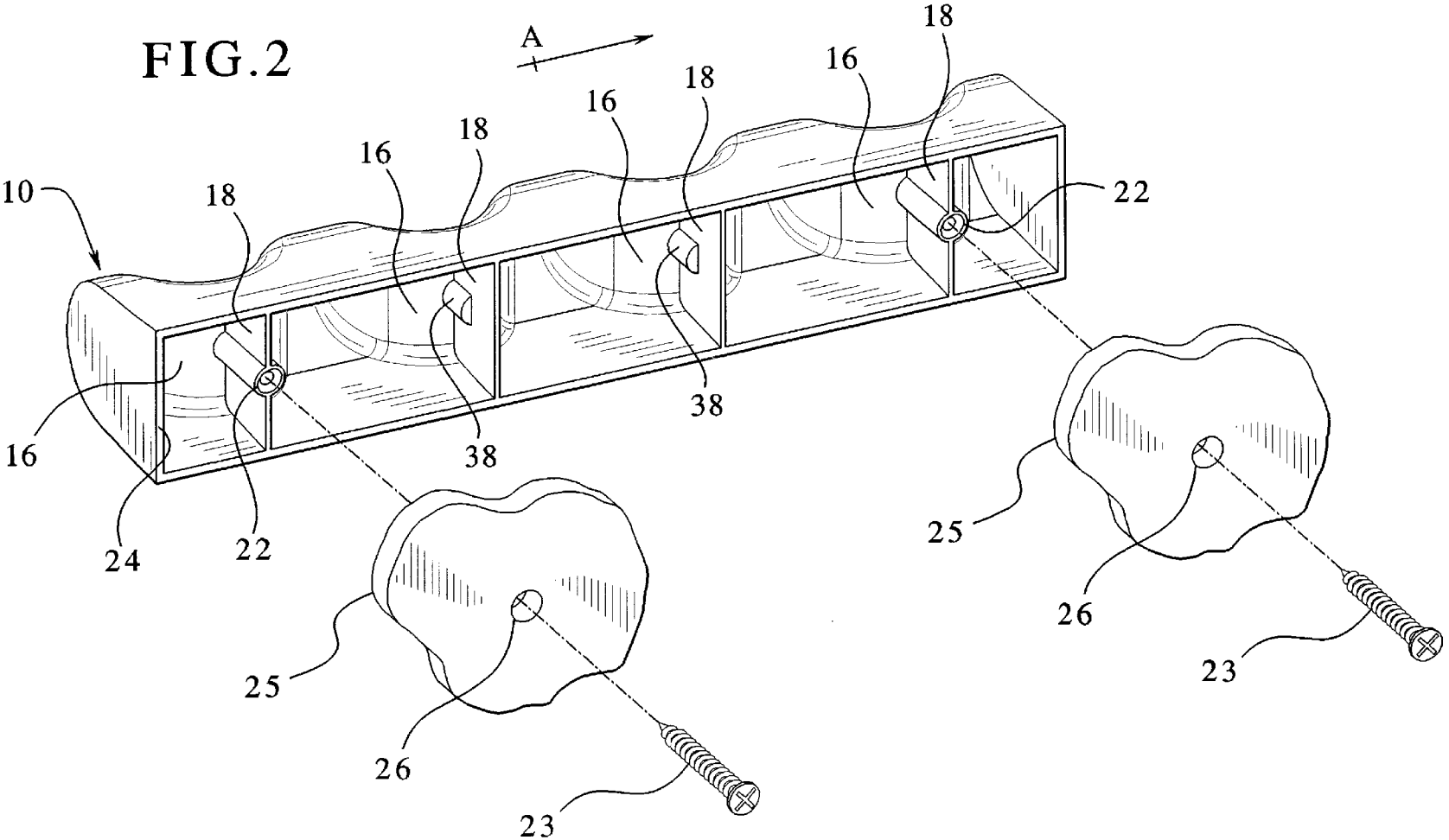
FIG. 2 is an exploded rear perspective view of the gun barrel rest.

As can be seen in FIG. 2, the gun barrel rest 10 is substantially hollow, and includes a cross brace 18 for each recess 16. The cross braces 18 provide for greater stability.

The gun barrel rest 10 is capable of being attached to any vertical surface. In the preferred embodiment, the gun barrel rest 10 of the present invention is utilized within a gun storage cabinet. Affixation means is provided for securing the gun barrel rest 10 to the vertical surface. In the preferred embodiment, the affixation means includes one or more first bosses 22 and one or more sheet metal screws 23. The first bosses 22 are preferably located on the outermost cross braces 18, and extend from the plane defined by rear edge 24. In the preferred embodiment, the first bosses 22 are self-threading. However, pre-threaded first bosses 22 are also contemplated.

To secure the gun barrel rest 10 to one of the cabinet vertical walls 25, the sheet metal screws 23 are inserted through wall apertures defined by edge 26, and into the corresponding first boss 22. It is preferred that the longitudinal axis A of the gun barrel rest 10 extend substantially parallel with the floor (not shown) of the gun storage cabinet.

Figure 3:
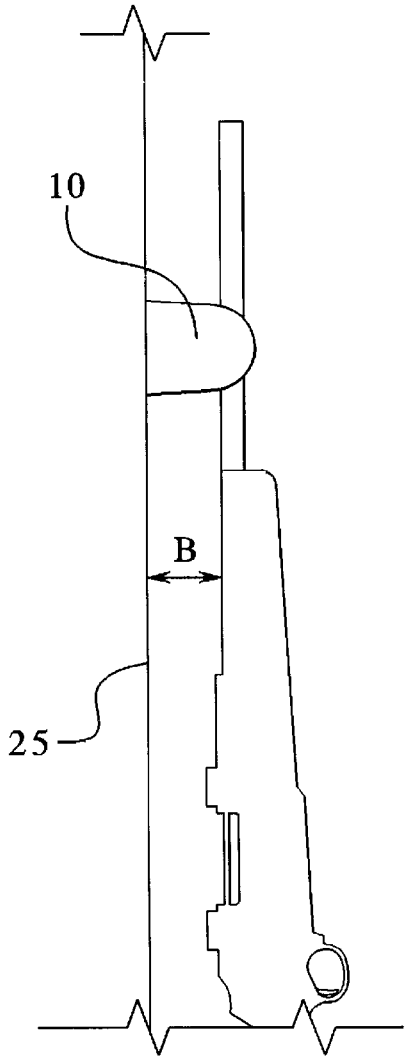
FIG. 3 is a side view of the gun barrel rest supporting a non-scoped gun.

FIGS. 1 and 3 illustrate use of the gun barrel rest 10 to support a non-scoped long arm gun, namely, a shotgun. As shown in FIG. 1, the barrel of the gun is inserted into the recess 16. As shown in FIG. 3, the gun is positioned at a first distance, defined by line B, from the vertical wall 25. The first distance B is the distance between the barrel of the gun and the vertical wall 25. The length of the first distance B depends on the distance between the recess 16 and the rear edge 24, as defined by line C (see FIG. 1).

In the preferred embodiment, the distance between the recess 16 and the rear edge 24 is equal for each recess 16. Further, the first distance B provided is sufficient to accommodate the majority of long arm guns. Alternate embodiments are contemplated wherein the distance between the recess 16 and the rear edge 24 varies for each recess 16.

Because space within a gun storage cabinet is limited, the supported guns should be positioned close to the vertical walls 25 of the gun storage cabinet. In other words, the first distance B should be minimized. Doing so will maximize the usable storage space within the cabinet. In the preferred embodiment, the first distance B provided by the gun barrel rest 10 is insufficient to accommodate a scoped gun. As such, a removable extender 30 is provided for increasing the distance between the vertical wall 25 and the gun barrel. Alternate embodiments are contemplated wherein the extender 30 and the gun barrel rest 10 comprise a unitary member.

In the preferred embodiment, the extender 30 has a fixed length. However, alternate embodiments are contemplated wherein the length of the extender 30 is adjustable, or wherein extenders 30 of various lengths are provided. It is preferred that the extender 30 be a unitary member constructed from a rigid material such as plastic, metal or the like.

Figure 4:
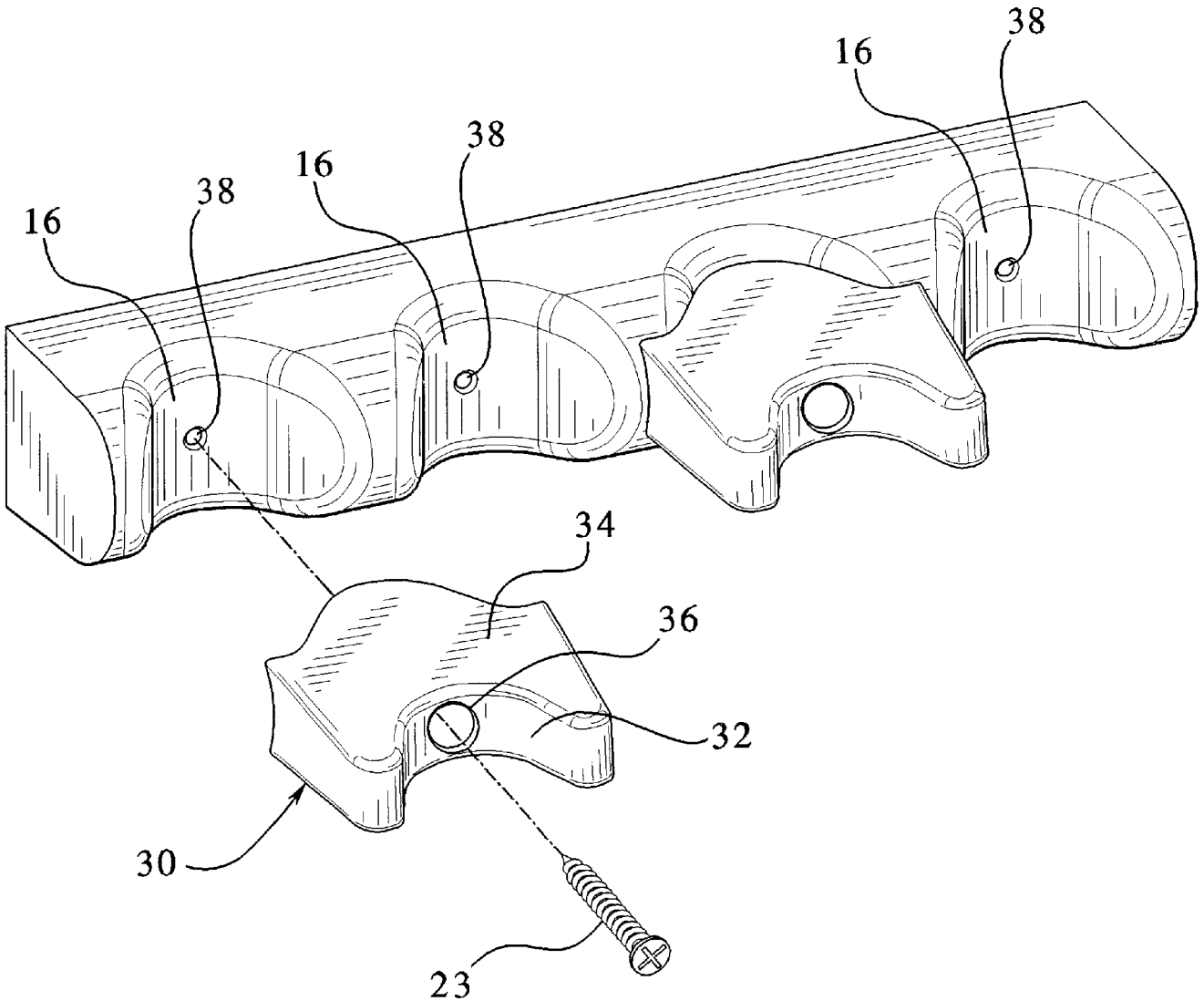
FIG. 4 is an exploded front perspective view of the gun barrel rest and extenders.

As shown in FIG. 4, the extender includes an extender recess 32 and an opposing convex-shaped tongue 34. The tongue 34 is adapted to matingly engage the gun barrel rest recess 16, and the tongue 34 substantially conforms and corresponds to the shape of the recess 16.

In the preferred embodiment, the extender recess 32 has a smaller width than the width of the gun barrel rest recess 16. However, extenders 30 having recess 32 widths which are equal or greater to the width of the gun barrel rest recess 16 are contemplated. As with the gun barrel rest recesses 16, one with ordinary skill in the art could readily ascertain the requisite extender recess 32 width and depth necessary to provide sufficient support.

Extender affixation means is provided for removably attaching the extender to the gun barrel rest 10. The extending affixation means includes a lipped bore defined by edge 36, a second boss 38 located on the gun barrel rest 10, and a sheet metal screw 23. To secure the extender 30 to the gun barrel rest 10, the sheet metal screw 23 is inserted through the bore 36 and into and a corresponding second boss 38. The head of the sheet metal screw 23 contacts the lip of the bore 36, thereby securing the extender 30 to the gun barrel rest 10. Each recess 16 is provided with a second boss 38. Each boss 38 extends from the recess 16 in the direction of the rear edge 23 (see FIG. 2). As illustrated in FIG. 2, a unitary boss is provided for those cross braces 18 which share a first boss 22 and a second boss 38.

As noted above, in the preferred embodiment each of the gun barrel recesses 16 are identical in depth, width and shape. Therefore, one extender 30 can be utilized with any one of the gun barrel rest recesses 16. Also, alternate embodiments are contemplated wherein the depth and width of each gun barrel rest recess 16 varies. In such an embodiment, a extender 30 must be provided which corresponds to each such recess 16.

When utilized, the extender 30 increases the first distance to a second distance defined by line D. The second distance D is of a length to provide sufficient space to accommodate a scoped gun.

Figure 5:
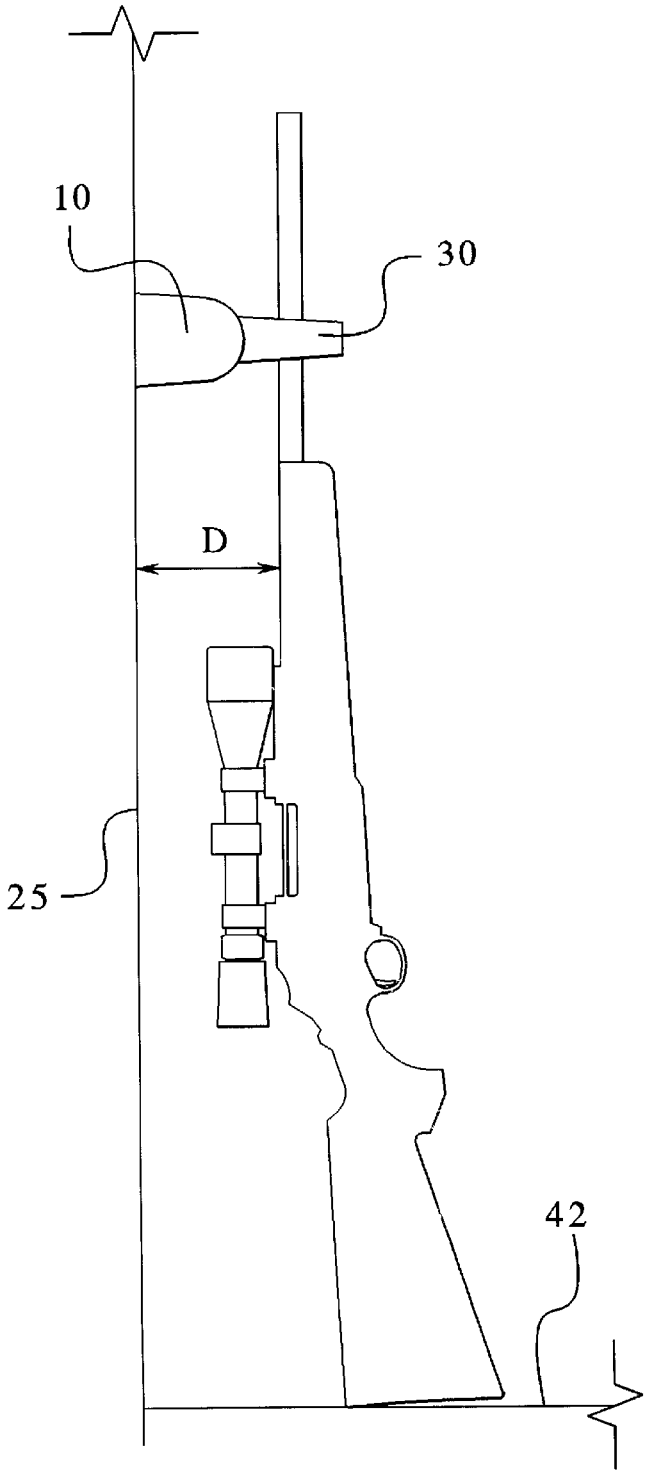
FIG. 5 is a side view of the gun barrel rest/extender combination supporting a scoped gun.

FIG. 5 illustrates use of the gun barrel rest 10/extender 30 combination to support a scoped long arm gun. The barrel of the gun is inserted into the recess 32 and the butt of the gun is placed on the cabinet flooring 42, thereby positioning the gun at a second distance, defined by line D, from the vertical wall 25. Like the first distance B, the second distance D is the distance between the vertical wall 25 and the gun barrel. Because the second distance D is greater than the first distance B, sufficient space to accommodate the scope is thereby provide.

The foregoing description of an embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims as set forth below.

What is claimed is:

1. A gun barrel rest for supporting at least one gun on a surface, comprising:

a body having a front portion and a rear portion;

said front portion having at least one gun barrel rest recess adapted to receive the barrel of the gun, said gun barrel rest recess adapted to prevent undesired movement of the barrel of the gun with respect to said body;

gun barrel rest affixation means operably associated with said body for affixing said body to the surface; and at least one extender extending outwardly from said body for providing additional separation of the barrel of the gun from the surface.

2. The gun barrel rest of claim 1, wherein said gun barrel rest recess is substantially concave.

3. The gun barrel rest of claim 1, wherein said front portion comprises more than one gun barrel rest recess.

4. The gun barrel rest of claim 1, wherein said at least one extender is adapted to be matingly received in said gun barrel rest recess.

5. The gun barrel rest of claim 4, wherein said extender includes a proximal end and a distal end;

said distal end being adapted to be matingly received in said gun barrel rest recess.

6. The gun barrel rest of claim 5, wherein said extender distal end is substantially convex; and wherein said gun barrel rest recess is substantially concave.

7. The gun barrel rest of claim 5, wherein said extender distal end includes an extender recess adapted to receive the barrel of the gun.

8. The gun barrel rest of claim 5, wherein said front portion comprises more than one gun barrel rest recess; and said extender is adapted to matingly engage any one of said more than one gun barrel rest recesses.

9. The gun barrel rest of claim 1, wherein said gun barrel rest affixation means extends into said body.

10. The gun barrel rest of claim 9, wherein said gun barrel rest affixation means comprises a screw and a boss passing transversely through said body toward said front portion.

11. A gun barrel rest for supporting a gun at a first distance from a surface, the gun having a barrel, comprising:

a body having a front portion and a rear portion;

said front portion of said body having a plurality of gun barrel receiving regions formed therein, said gun barrel receiving regions adapted to receive the gun barrel;

at least one extender having a first end adapted to be received in at least one of said plurality of gun barrel receiving regions; said extender having a second end located distally from the surface, said second end adapted to receive the barrel of the gun so as to support the gun barrel at a second distance from the surface;

extender affixation means operably associated with said body for affixing said extender to said gun barrel rest recess; and gun barrel rest affixation means operably associated with said body for affixing said body to the surface.

12. The gun barrel rest of claim 11, wherein said extender is adapted to be received by any one of said plurality of gun barrel receiving regions in substantially mating relation.

13. The gun barrel rest of claim 12, wherein said plurality of gun barrel receiving regions are substantially concave.

14. The gun barrel rest of claim 13, wherein said extender first end is substantially convex.

15. The gun barrel rest of claim 14, wherein said extender second end includes a recess adapted to receive the barrel of the gun.

16. The gun barrel rest of claim 11, wherein said gun barrel rest affixation means comprises a screw and a first boss passing transversely through said body rear portion.

17. The gun barrel rest of claim 11, wherein said extender affixation means comprises a screw, a bore passing transversely through said extender, and a second boss passing transversely through said body front portion.

* * * * *